United States Patent [19]

Nickipuck

[11] Patent Number: 4,905,549

[45] Date of Patent: Mar. 6, 1990

[54] POWER DRIVEN WRENCH RETENTION DEVICE

[75] Inventor: Michael F. Nickipuck, Brookfield, Ill.

[73] Assignee: 501 Qualicorp, Ltd, Westmont, Ill.

[21] Appl. No.: 239,696

[22] Filed: Sep. 2, 1988

Related U.S. Application Data

[63] Continuation-in-part of Ser. No. 45,781, Apr. 30, 1987, Pat. No. 4,768,405.

[51] Int. Cl.[4] ..... B25B 13/00

[52] U.S. Cl. ..... 81/177.85; 403/365

[58] Field of Search ..... 81/177.85, 53.2, 124.4, 81/439, 177.4, 177.2, 9; 279/2 R, 75, 76; 403/365, 367

[56] References Cited

U.S. PATENT DOCUMENTS 1,807,134 5/1931 Pfauser ..... 81/177.85

4,768,405 9/1988 Nickipuck ..... 81/177.85

*Primary Examiner*—Frederick R. Schmidt

*Assistant Examiner*—M. Rachuba

*Attorney, Agent, or Firm*—Myers & Ehrlich, Ltd.

[57] ABSTRACT

A power socket wrench locking and release apparatus uses a longitudinally sliding locking member which co-acts with securing or retaining detent elements. The detent elements use a projecting member and a retracting spring for retraction and are locked in place by the locking member.

13 Claims, 1 Drawing Sheet

PRIOR ART

POWER DRIVEN WRENCH RETENTION DEVICE

BACKGROUND OF THE INVENTION

This is a continuation-in-part of Ser. No. 045,781, filed Apr. 30, 1988, now Pat. No. 476,840. This co-pending continuation-in-part Ser. No. 07/045,781 is directed to an improved locking arrangement. My Continuation In Part application filed Aug. 24, 1988, now assigned Ser. No. 07/235,287 is an improvement in the control bar locking assembly. The present Continuation In Part assembly appertains to a unique retainer for use in power driven tool. Patent, No. 4,480,511, is directed to a locking arrangement for retaining sockets on a shank.

DISCUSSION OF THE PRIOR ART

The typical power-operated wrench is an impact wrench which utilizes a calibrated rotary hammer to exert torque of a selected value. This is used to drive a socket to tighten or loosen a fastener such as a nut or bolt. Several factors make this application significantly different than that of hand operated tools. First the torque generated is significantly greater than can be generated by a hand tool. Second, the speed of rotation is greater than and is maintained over a longer period of time than a manual tool. Third, when the load is released as when a fastener is completely removed, a mechanical element breaks, or the power tool is accidentally operated without load, the tool may rotate at an unwantedly fast speed. Fourth, the cyclical nature of the forces used to impart rotation creates higher stress peaks. Under these circumstances it is desirable to have a retainer element with a more positive engagement on the socket than can be accomplished using a ball-bearing type retainer, or other retainer with a projecting hemispherical surface.

In the prior art impact tools utilize sockets designed specifically for the purpose of being driven by impact wrenches. These sockets differ from standard sockets in the addition to mass and composition of the metals used and by having a parallel walled bore extending through the outer surface to one driven wall. This bore is analogous to the retention recess in many manually driven socket extensions but is uniquely adapted to the conditions of impact or power driven wrench driving.

The driving end of the tool in the prior art uses a pin projecting from a retainer element instead of a ball or hemispherical surface. The pin extends farther into the bore of the aforementioned socket and provides a greater surface area to retain the socket.

Release of prior art impact tool retention devices is accomplished through the use of an implement inserted in the bore in the socket and depressing the pin against a spring which forces it outward. This has a number of disadvantages. A separate tool is prone to loss, breakage or misuse. There may be delays and inefficiencies in changing sockets because of the need to manipulate the tool. There may be a tendency to misuse tools not intended to be used as pin depressing implements, such as screwdrivers or the like, and other disadvantages.

BACKGROUND OF THE INVENTION

My invention utilizes a positive locking feature of the control bar and first an extension of spring to urge the control bar into a locking position to force a retaining pin into a locked position. In the prior art arrangement a spring directly forces a pin into a locked position. Conversely in my invention I use a second spring to retract the pin from locked position. I use a control bar to engage the retainer assembly a ball and pin, to force the pin into a positively locked position. In my arrangement my device does not use the same spring to maintain the pin in locked position. My arrangement presents a number of advantages.

One advantage is the use of a transverse spring to push the pin through the control bar into the locked position. The axial spring is a larger and less fatigue-prone spring.

Another advantage is that the locking motion is generated by the axial spring in a direction perpendicular to the direction of motion of the locking pin.

Another advantage is that in the locked position, the pin is held in place by the contact of solid elements rather than by spring pressure of a spring. The solid components are less prone to fatigue than said springs used in prior art devices.

Another advantage of my invention is that removal of sockets for changing is simplified.

Another advantage of my invention is that it facilitates the placement of sockets on the tool for use or when changing sockets.

These and other objects and advantages of the invention will become more apparent from the specification and the drawings, herein.

DETAILED DESCRIPTION OF THE PREFERRED EMBODIMENT

Figure 1:
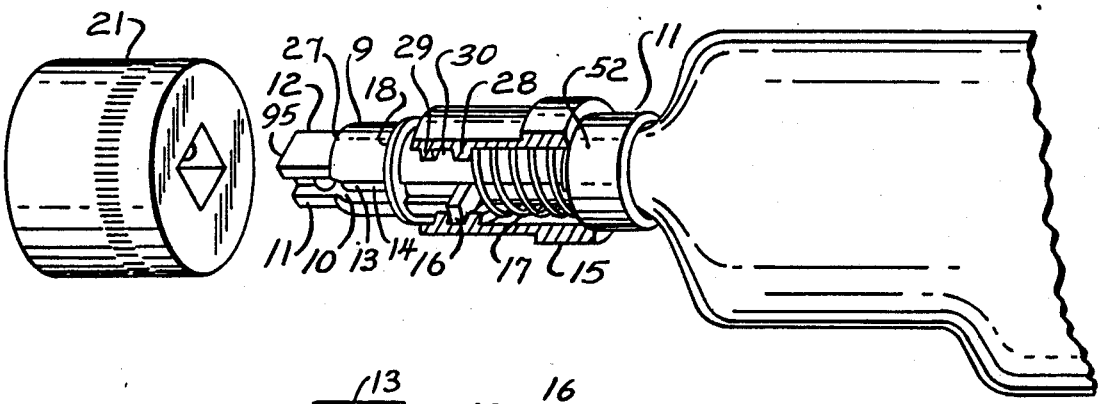
FIG. 1 is a perspective cut away view of my invention.

FIG. 1 illustrates a socket locking assembly with a driven portion (11) extension shank (9) and square driving portion (12). The driving portion (12) fits into socket (21) for imparting rotational movement.

The shank (9) terminates at a shoulder (27) at the end of the shank (9). A slot or channel (10) is formed in the surface of the shank and extends into one face or wall of the drive portion (11).

A control bar (14) which has an outer surface (13) is carried in a controlbar channel 10. A raised portion or spur (16) extends outwardly from the outer edge (13) and fits into a sleeve (15). The sleeve has internal annular engagement elements or flanges. In this embodiment these constitute an inner annular ring (28) and terminal annular ring (29) of the sleeve defining an annular groove (30) between them. This preferred embodiment sleeve does not foreclose the use of other methods of engagement. A first or axial spring (17) urges the sleeve and control bar into the locked position. The forward locked position motion of the sleeve toward the driving end is limited by a circular clip (18) fitted into an annular groove in the shank (9). The clip may also be used to limit radial outward movement of the control bar. Rearward movement of the assembly is limited by a limiting collar (52) which may be a raised annular ridge on the shank (9) or a separate piece which engages the sleeve. In the preferred embodiment the sleeve may be covered with a grip surface pattern such as knurling, or other arrangements making the sleeve easy to grip and retract.

Figure 2:
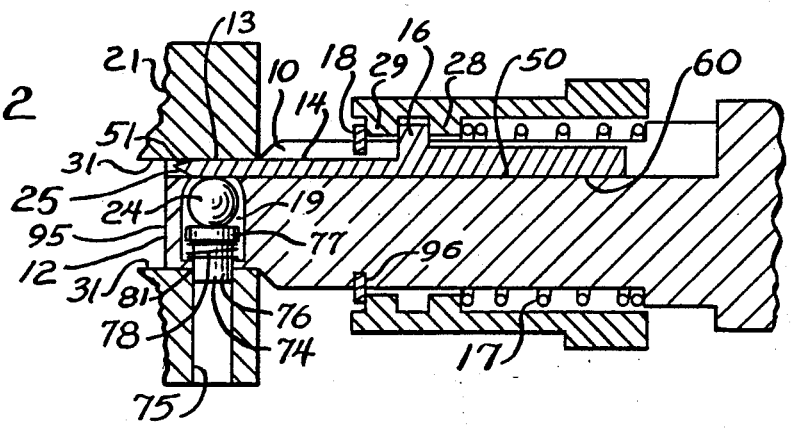
FIG. 2 is a sectional view of my invention in the locked position.

FIG. 2 is a sectional view of the preferred embodiment. The socket (21) has a plurality of faces (31) which engage the drive portion (12). Apparent in this view is a transverse bore (19) in which a retainer ball (24 and a retainer pin (74) are carried. The control bar (14) carried in the control bar channel (10) extends forward or toward the distal end (95) (to the left). The outer surface (13) of the control bar which rides under the stop ring (18) engages a wall of the socket (31) when in the locked position. The inner surface (50) of the control bar slides on the floor (60) of the channel (10). The inner surface (50) merges into a bevel (25) which slides over ball (24). It has been found in development that a bevel angle of between approximately 10 and 30 degrees is preferable. For improved clearance and engagement of the socket, the tip of the control bar is also beveled at (51) adjacent to the outer surface (13).

Further apparent in this view are the sleeve-control bar engagement shoulders (28) and (29) which flank and engage the outwardly extending spur (16) of the control bar permitting fore and aft retraction and extension against a force through the action of a compressed coil spring (17). As noted in connection with FIG. 1 forward and radially outward motion is limited by the circular clip (18) snapped into groove (96) in the shank although other appropriate structures including the sleeve (15) may be used.

The locking or securement of the socket (21) to the driving end (12) is accomplished through the engagement of an outwardly projecting detent or pin (74) with a cylindrical opening (75) in the socket. Typically a socket design for power driven use has a single hole drilled through one wall of the socket.

The pin (74) has a cylindrical projecting portion (76) which projects through the transverse bore (19) in the shank and engages in the cylindrical opening (75) of the socket (21) to lock the socket in place when the control bar (14) is in the locked position.

With the control bar held in this position by the first or axial, spring (17), a positive lock is maintained by the other surface (13) of the control bar bearing on the socket wall (31) opposite the retainer opening (75), the inner surface (50) of the control bar bearing on the retainer ball (24) which in turn bears on the head (77) of the pin (74). This head is of a larger diameter than the projecting locking portion (76) and provides a bearing surface for the retainer ball (24) on one side and for a second, or transverse retracting or biasing spring (78) which reacts against the inside surface of the head and is sleeved on the pin (74) and bears against an opposing shoulder on the shank within the bore (19) at the outlet end (81) thereof.

Figure 3:
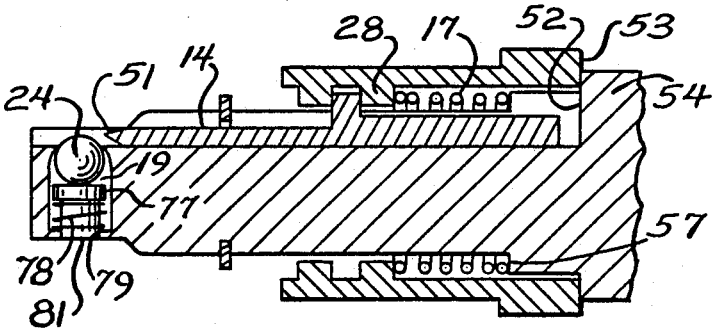
FIG. 3 is a view of my invention in the retracted position.

As shown in FIG. 3, the spring (17) is compressed between the engagement shoulder (28) of the sleeve in the limiting collar (52) and an opposing shoulder (57) of the limiting collar. The limiting collar itself maybe a raised annular ridge of the shank a separate piece carried on the shank or other prosecution. The limiting collar incorporates an outwardly extending shoulder (54) extending from the circumferential surface and engages the rearward end (53) of the sleeve (15) at the rearward most extension of travel. Movement rearward (rightward) to the shoulder (54) retracts the control bar (14). The retainer ball (24) is permitted by movement of the bevel to move transversely outwardly.

When the control bar (14) is retracted upward biasing of the retainer ball (24) and pin (74) results from the pressure of the transverse or biasing spring (78) against the lower portion of the head (77). The action of the second, or transverse, spring (78) is the opposite of the action of the transverse spring in the prior art in that my transverse spring unlocks the pin (74) from engagement with the socket while the prior art uses a spring to hold a pin in a locked position.

Figure 4:
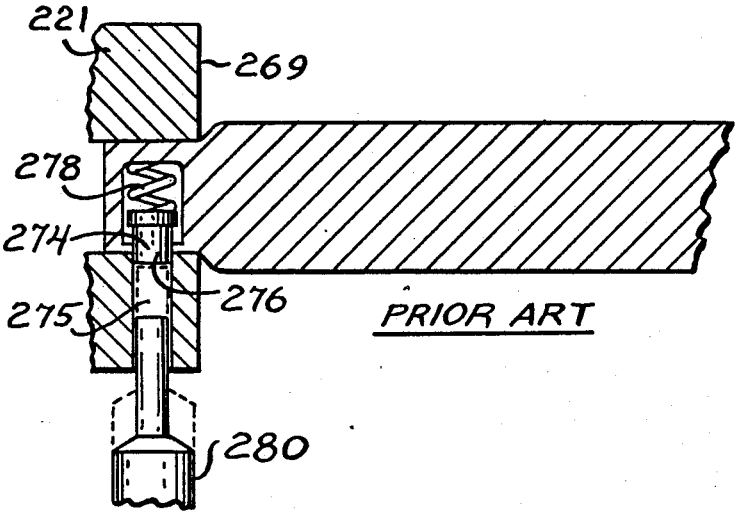
FIG. 4 is a sectional view of prior art power socket wrench retention devices.

FIG. 4 shows the prior art power wrench socket locking arrangement. In this arrangement the pin (274) is held in place by the outward pressure of the spring (278). This pin (274) engages the bore (275) in the socket (221). In this way the socket is retained from unwanted forward (to the left) motion while in operation. In order to remove the socket (221), an implement (280) must be inserted in the bore (275) to engage the projecting portion of the pin (276). The implement (280) is then forced transversely (upward) against the spring pressure while the socket is simultaneously withdrawn, the implement holding the pin in a retracted position. Whenever the force on the pin against the expansion of the spring is released, the pin returns to the locked position. Whenever the implement (280) is withdrawn, or the socket (221) is completely withdrawn, the pin returns to the locked position. Thus, two hands are typically required to manually remove a socket, one to manipulate the socket (221), the other to manipulate the implement (280 , or extreme dexterity is required to both exert the transverse force on the implement (280), and the longitudinal force on the socket (221), while still holding the power wrench itself.

Further, in order to replace the socket, the pin must also be retracted against the transverse spring pressure because the pin (274) is substantially parallel to the rear portion (269) of the socket (221). This may be done by the use of a fingernail, in small diameter power wrenches, but may require the use of an implement particularly against the higher spring pressure in larger diameter wrenches. The pin must be held with the spring compressed as the socket is inserted. My invention permits the retraction and holding of the tool with one hand while the socket can usually be manipulated with the other hand dispensing with the implement. Further, my tool uses positive locking to hold the pin in the extended, or projecting position.

In accordance with my invention, I claim:

1. In a tool for securement to socket members having variously spaced walls and a securement opening with a retention aperture, a securement device for connecting such socket members with the tool for rotation therewith comprising:

a shank member adapted to be selectively entered within the securement opening;

a control bar member supported on the shank member for longitudinal movement with respect thereto to a locket position, and to a retracted release position, with accompanying generally radial movement on the shank member toward and away from an adjacent wall of a socket member for locking engagement therewith and release therefrom;

detent means supported on the shank member for movement transversely with respect thereto for selectively securing and releasing said shank member with respect to said socket member;

said control bar member having an outward surface facing generally away from the shank member, and an acutely angled inward cam surface facing the shank member, and a locking surface facing the shank member;

said locking surface of the control bar slidingly engaging the detent means attendant to the control bar being moved into the locked position to extend said detent means transversely outward to engage said aperture in the socket member for securing the socket member interlocked with the shank member whilst;

the control bar is moved generally radially outwardly from the shank member and said outward surface of the control bar is caused to engage an opposing wall of the socket member within the opening therein coincident with the transverse extension of the detent means in engagement with said aperture;

a transverse spring biasing said control bar and detent means radially;

said control bar and detent means movable radially subject to the force of said transverse spring;

said detent means comprising a cooperatively associated pin and a retainer ball;

said shank member having a driven end, and means for interlocking the driven end with associated driving means;

said shank member comprising first and second longitudinal motion limiting means means for engagement with said control bar;

radially outward movement limiting means on said shank member, and a surface on said shank member for limiting radially inward movement of the bar;

said detent means being biased to retract to facilitate withdrawal of said shank member from the socket.

2. In a tool for driving socket members having an engagement opening defined by walls with a shank having a driven end and a driving end, engageable with the wall so said engagement opening for rotation therewith, comprising;

the driving end having locking structure with axially displaceable locking means slidably carried on the shank and transversely displaceable securement means extending through said driven end from said locking means to the wall opposed therefrom; and said socket member having a retainer recess; and said securement means selectively engaging said retainer recess b y projecting engagement to lock the socket to the shank and disengaging by retracting disengagement to release the socket from the shank; and said locking means comprising a control bar;

said control bar having manual gripping means for movement thereof, said control bar further having locking surface means engaging said securement means and socket wall engagement means engaging a wall of said socket in a locked position; and said control bar having a release surface merging into said locking surface for progressive disengagement of said securement means as said locking means are moved to a release position; and limiting means maintaining said control bar in a finite range of radial movement; and shoulder means disposed on the surface of said shank; and spring engagement means being disposed on said gripping means distal from the release surface; and an axial spring being carried on said shank disposed between said shoulder means and said spring engagement means to maintain said locking means in a locked position until operatively released; and said securement means comprising transverse carriage means having surface means and projection limiting means projectedly carrying said securement means; and said securement means having first bearing means in releasable engagement with the locking surface of said locking means; and said securement means having second bearing means and retraction means, pin means with projecting means and second bearing means thrustedly disposed between first bearing means and retraction means; and said retraction means being expandably disposed between said second bearing means and said limiting means;

whereby, said projecting means is radially outwardly extended with the assembly is in a locked position and retracted when the assembly is in a released position.

3. A socket wrench tool comprising a shank having driven means at one end for attachment to operating means and mounting means on the other end for mounting and retaining a wrench socket having walls defining a securement opening and a pin engagement aperture in a wall for locking the socket to the shank, said mounting means comprising self-retracting detent means mounted on the shank for movement between an extended position extending into said aperture and a retracted position withdrawn from the aperture, means for biasing said detent means to said retracted position, said mounting means comprising locking means on the shaft movable between locking and unlocking positions with respect to said detent means;

said locking means operative in the locking position to move said detent means to its extended position against the resistance of said biasing means and operative in the unlocking position to release said detent means to retract with the assistance of said biasing means to its retracted position with respect to the aperture.

4. The invention according to claim 3, and said detent means being transversely movable in the shank.

5. The invention according to claim 3, and said mounting means being longitudinally movable in the shank.

6. The invention according to claim 3, and said mounting means comprising a control bar element movable into locking position with respect to said detent means to prevent the retraction of the detent means and movable to unlocking position to accommodate retraction of the detent means.

7. The invention according to claim 3, and said detent means movable transversely of the shank and said mounting means movable longitudinally of the shank, and 8. The invention according to claim 3, and and said mounting means comprising an element movable into locking position with respect to said detent means to prevent its retraction and movable to unlocking position to accommodate retraction of the detent means.

9. A tool having shank means for releasable attachment to an operator at one end and to a wrench socket at its other end, means for locking said socket on said shank on said other end comprising detent means normally spring-biased to a retracted position, a locking bar movably mounted on the shank for insertion between a wrench socket attached to said shank and said detent means for extending the detent means into locking engagement with the socket in opposition to the spring bias thereof.

10. The invention according to claim 9, and said detent means comprising a rigid structure extending between said bar and said opposed portion of the socket.

11. The invention according to claim 10, and said rigid structure comprising a pin having a head and a spring compressed between the head and an opposing portion of the shank.

12. The invention according to claim 11, and said pin having a shank extending through the spring.

13. The invention according to claim 9, and a spring compressed between said shank means and said bar and urging the bar to extended position.

* * * * *